US011259591B2

(12) United States Patent
Souyri et al.

(10) Patent No.: US 11,259,591 B2
(45) Date of Patent: Mar. 1, 2022

(54) SHOE SOLE COMPRISING INJECTED BARS

(71) Applicant: COMPAGNIE GENERALE DES ETABLISSEMENTS MICHELIN, Clermont-Ferrand (FR)

(72) Inventors: Philippe Souyri, Clermont-Ferrand (FR); Bozena Voge, Clermont-Ferrand (FR); Bertrand Barre, Clermont-Ferrand (FR); Francis Lepage, Clermont-Ferrand (FR)

(73) Assignee: COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 28 days.

(21) Appl. No.: 16/308,604

(22) PCT Filed: Jun. 9, 2017

(86) PCT No.: PCT/IB2017/053441

§ 371 (c)(1),
(2) Date: Dec. 10, 2018

(87) PCT Pub. No.: WO2017/212458

PCT Pub. Date: Dec. 14, 2017

(65) Prior Publication Data

US 2019/0150561 A1 May 23, 2019

(30) Foreign Application Priority Data

Jun. 10, 2016 (FR) ..... 16/00943

(51) Int. Cl.
*A43B 13/14* (2006.01)
*A43B 13/18* (2006.01)

(52) U.S. Cl.
CPC ..... *A43B 13/181* (2013.01); *A43B 13/141* (2013.01); *A43B 13/183* (2013.01); *A43B 13/184* (2013.01)

(58) Field of Classification Search
CPC ..... A43B 13/04; A43B 13/125; A43B 13/141; A43B 13/181; A43B 13/183; A43B 13/185; A43B 13/186
See application file for complete search history.

(56) References Cited

U.S. PATENT DOCUMENTS 4,536,974 A 8/1985 Cohen
4,753,021 A * 6/1988 Cohen ..... A43B 13/181 36/3 B
5,337,492 A 8/1994 Anderié et al.
(Continued)

FOREIGN PATENT DOCUMENTS

CA 2 924 736 A1 3/2015
WO 2006/036608 A1 4/2006

OTHER PUBLICATIONS

International Search Report dated Sep. 20, 2017, in corresponding PCT/IB2017/053441 (6 pages).

*Primary Examiner* — Sharon M Prange
(74) *Attorney, Agent, or Firm* — Venable LLP

(57) ABSTRACT

A shoe sole (1) comprising an outsole (3), an insole (2) and a midsole (5) which extends between the insole (2) and the outsole (3), the midsole (5) being composed of a plurality of bars (6) which are substantially transversal and are aligned substantially longitudinally over the length of the sole, the insole (2) and the bars are composed of an elastomeric material.

13 Claims, 3 Drawing Sheets

(56) References Cited

U.S. PATENT DOCUMENTS

| | | | | |
|---|---|---|---|---|
| 5,461,800 | A | 10/1995 | Luthi et al. | |
| 5,822,886 | A | 10/1998 | Luthi et al. | |
| 6,675,500 | B1 * | 1/2004 | Cadamuro | A43B 1/0018 36/27 |
| 6,763,611 | B1 * | 7/2004 | Fusco | A43B 13/125 36/25 R |
| 7,013,582 | B2 * | 3/2006 | Lucas | A43B 1/0009 36/28 |
| 7,055,198 | B2 * | 6/2006 | Cadamuro | A43B 13/186 36/28 |
| 7,401,419 | B2 * | 7/2008 | Lucas | A43B 1/0009 36/27 |
| 7,464,489 | B2 * | 12/2008 | Ho | A43B 13/181 36/28 |
| 9,271,542 | B2 * | 3/2016 | McCue | F16F 3/0873 |
| 9,480,298 | B2 * | 11/2016 | Barnes | A43B 7/144 |
| 2011/0138652 | A1 | 6/2011 | Lucas et al. | |
| 2015/0013195 | A1 | 1/2015 | Baker et al. | |
| 2016/0183632 | A1 * | 6/2016 | Scofield | A43B 13/125 36/28 |
| 2016/0219974 | A1 | 8/2016 | Izquieta Anaut | |
| 2018/0125148 | A1 * | 5/2018 | Elder | A43B 13/125 |
| 2019/0193358 | A1 | 6/2019 | Souyri | |

* cited by examiner

SHOE SOLE COMPRISING INJECTED BARS

TECHNICAL FIELD OF THE INVENTION

The present invention concerns a shoe sole comprising an outsole, an insole and a midsole which extends between the insole and the outsole, the midsole being composed of a plurality of substantially transversal bars which are aligned substantially longitudinally over the length of the sole.

PRIOR ART

Patent application US2011/138652 proposes a sports shoe.

The shoe includes a sole which comprises a plurality of leaf spring elements in the front-foot area. The insole and the plurality of leaf spring elements are produced in one single part. Each of the plurality of leaf spring elements has a free end which is not connected to the insole. Said type of arrangement uses the flexibility and the deformability of the leaves in order to generate the absorption and the comfort of the shoe. The very limited number of leaf springs, however, creates an effect of fits and starts since, during walking, the leaves are deformed one by one in succession. When the force of one leaf transitions toward the next leaf, a large variation in the support force is produced which reduces the comfort and can inconvenience the user.

Document WO2006036608 describes a system with springs/shock absorption which is able to include a first and a second part which form a body and at least one spring element at least partially included between the parts which form the body. The spring element or elements can essentially include and/or be engaged by rotation in the part or the parts which form the body. The components of the spring and shock absorption element can be arranged such that when a force is applied to a part or to the parts which form the body, the spring element or spring elements exert a counter force in order to push the spring and shock absorption element to return into its initial orientation. The spring elements can include one or multiple polymeric elements which are stretched under the effect of a tractive force. The spring and shock absorption elements can be integrated in a shoe part or in another device such that a user or a retailer (or others) can select an appropriate spring element (or part of the same), for example according to the characteristics of the user or of the intended use. Such a solution is complicated to implement, is likely to have unfavourable ageing characteristics and is prone to have support discontinuities.

Document US2015013195 describes a sole, the heel of which has a plurality of suspended arms. The set of suspended arms includes a base part which is fixed to the sole of a shoe. Said arrangement allows the arms to be moved independently of the sole in order to supply a greater traction capacity. Said solution is adapted to a particular type of sports shoe, but has a certain discomfort when walking for example, as a result of the low number of contact points.

Document U.S. Pat. No. 4,536,974 describes a shoe which contains a plurality of pairs of transverse ribs which are provided between the midsole and the outsole. The ribs are provided with at least one curved or convex surface which extends over their length. When a load is placed on the sole, each of the ribs starts to weaken until they are completely compressed.

It is noted that the disclosed solutions do not allow soles with good characteristics of homogeneity to be obtained. Furthermore, the disclosed soles do not offer optimum comfort to the user. It is equally difficult to control the deformations of the sole when it is in use.

Finally, the weight of the soles is a concern that has not yet been resolved. It is difficult to obtain soles that are as light as possible.

In order to overcome said various disadvantages, the invention provides various technical means.

SUMMARY OF THE INVENTION

First of all, a first object of the invention consists in providing a shoe sole that simultaneously unites lightness, flexibility, comfort and ease of production.

Another object of the invention consists in providing a sole where the comfort characteristics are long-lasting.

Yet another object of the invention consists in providing a sole which allows the dynamic characteristics, notably the restoration of energy, to be optimized.

Yet another object of the invention consists in providing a sole which is suitable to be realized in an automated manner, with one single process for all the constituent elements.

To do this, the invention provides a shoe sole comprising an outsole, an insole and a midsole which extends between the insole and the outsole, the midsole being composed of a plurality of bars which are arranged lengthwise of the sole, the insole, the bars and the outsole being composed of an elastomeric material, said bars being fixed on one side against the lower surface of the midsole and on the other side against the upper surface of the outsole, the outsole forming, between the bars, a plurality of elastic areas, at least part of which comprises a fold, the elastic areas being deformable plastically by unfolding the folds and elastically by stretching the elastic areas.

The two types of deformations, when exposed to the effects of a first level of crushing force originating from the foot of the user, permit the folds of the insole to be deployed, causing a first level of elongation, and, when exposed to the effects of a second level of force originating from the foot, greater than the first level of force, the material of the elastic areas to be deformed by stretching, causing a second level of elongation of the outsole, greater than the first level of elongation. The fact that the bars are all fixed at their base leads to collective deformation of the bars. Said type of deformation allows a good level of comfort to be kept, in particular by avoiding forces in fits and starts such as those which are produced with a sole which comprises only a few springs, where the user feels the flow between each of the springs. Compared to classic soles realized with a midsole produced in a deformable foam material, the sole of the invention implements a material that is incompressible but configured according to a deformable design.

Said design allows the sole to be produced in a simple, economic manner with a high degree of automation. The sole obtained is very light, comprises excellent mechanical properties and notably very good grip, but also structural support which ensures a good compromise between rigidity and absorption. Its high level of homogeneity makes the sole particularly effective and long-lasting. The single material used has very good injection characteristics, its mechanical support properties are particularly favourable for use as structural material of the sole, and its elevated grip properties make it a material particularly suitable to ensure good contact with the ground without sliding under normal conditions of use. Since the injecting is advantageously realized with a single elastomeric material, an elastomeric mixture allows an excellent compromise, imparting high levels of performance with respect to requirements that are often contradictory such as structural support and good hold on the ground, in particular a good level of grip. Thanks to the design provided, the elastomeric material, in spite of its non-compressibility, has excellent flexibility and a good level of absorption. The bars can be realized by injection, which allows production costs to be reduced in a considerable manner compared to classic production methods, notably thanks to the improved possibilities of automation.

According to an advantageous embodiment, the elastic areas allow two types of deformation of the outsole, the unfolding of the folds entraining a first level of deformation of the bars and the stretching of the elastic areas entraining a second level of deformation of the bars.

According to an advantageous embodiment, each bar is formed by the arrangement of two walls which are arranged in close proximity to one another.

According to an advantageous embodiment, the outsole is produced in one piece with the bars of the midsole. In a variant, the insole, the bars and the outsole are obtained by injection.

In an advantageous manner, the elastic areas are produced in one piece with the bars. In a preferred manner, the outsole is produced in one piece with the bars of the midsole. Said characteristics can be realized advantageously as a result of the material, in particular the elastomeric mixture, allowing all the structural and gripping criteria to be fulfilled. It is therefore possible to realize all of the sole from one single material, without losing either comfort or performance, in contrast to shoes of the prior art.

According to an advantageous embodiment, at least some of the bars are substantially transversal.

According to another advantageous embodiment, at least some of the bars are substantially longitudinal. As a variant, at least some of the bars are aligned at an angle which is included between 0° and 90° with respect to the longitudinal axis of the sole.

According to a preferred embodiment, the sole comprises several sets of bars, a set of substantially transversal bars and a set of substantially longitudinal bars.

In another variant, the insole, the bars and the outsole are obtained through the addition of material (3D printing).

In an advantageous manner, each bar is formed by the arrangement of two walls which are arranged in close proximity with one another.

According to yet another advantageous embodiment, at least some of said bars are interrupted in the middle portion of the sole, thus obtaining optimized lightening of the sole.

The invention also provides a shoe which includes a sole such as described beforehand.

DESCRIPTION OF THE FIGURES

All the details for realization are given in the following description, supplemented by FIGS. 1 to 6 which are provided solely for non-limiting illustrative purposes, and in which.

DETAILED DESCRIPTION OF THE INVENTION

Figure 1:
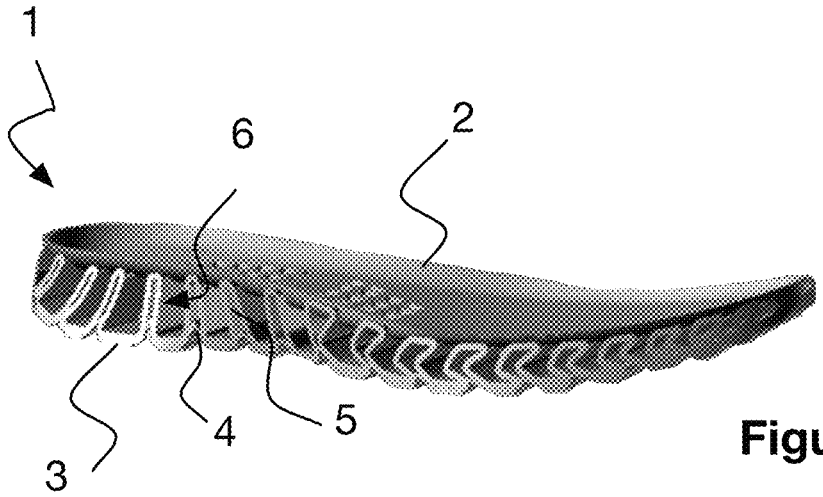
FIG. 1 is a perspective view of a first example of a sole according to the invention.

As shown in FIGS. 1 to 3A, the shoe sole 1 comprises classically an outsole 3, an insole 2 and a midsole 5. This latter extends between the insole 2 and the outsole 3. The midsole 5 is composed of a plurality of bars 6. In said embodiment, the bars 6 are substantially transversal. The bars 6 can be continuous or discontinuous from one side to the other of the sole. In said example, the sole always comprises a plurality of bars which are aligned in succession from the area of the heel to the area provided to be situated under the shoe-upper. The alignment can be regular or irregular, according to the embodiments.

Figure 3A:
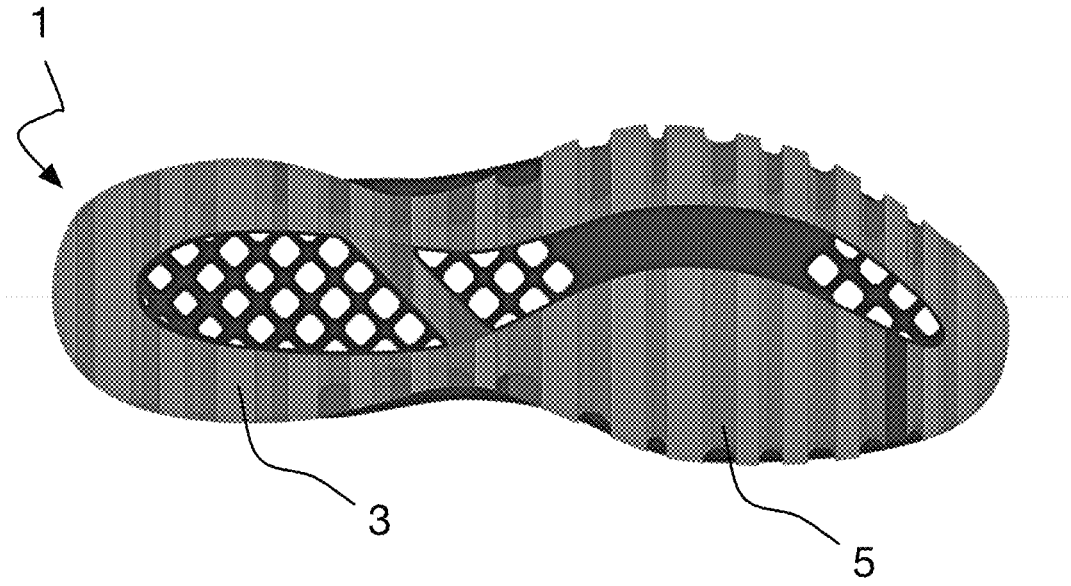
FIG. 3A is a view from below of the sole in FIG. 1.
Figure 3B:
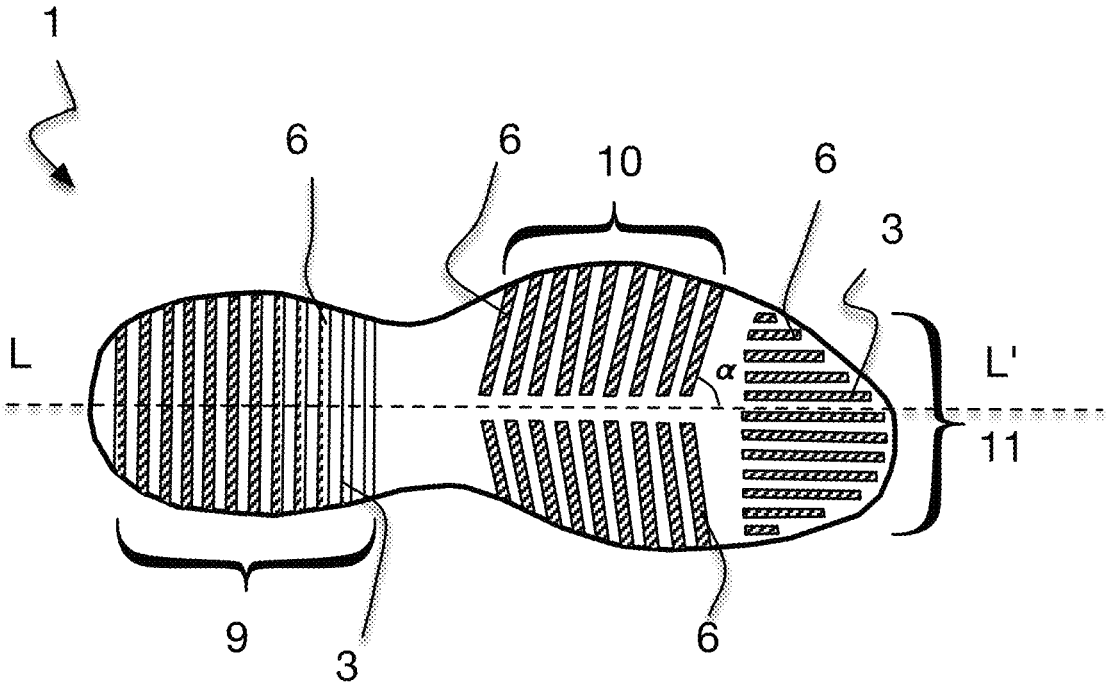
FIG. 3B is a view from below of another embodiment of the outsole and the midsole.

In the embodiment shown in FIG. 3B, the sole comprises multiple sets of bars 6. One set consists of a group of bars which are substantially parallel. 3 sets of bars can be seen in said example. A first set 9 in the area of the heel, in which the bars are substantially transversal, a second set 10 in which the bars are arranged at an angle alpha of about 60° with respect to the longitudinal axis L-L of the sole, and one set 11, right at the front of the sole, in which the bars are substantially longitudinal. In said example, the area 10 is provided between the areas 9 and 11. According to various variants, the number of areas and their respective arrangement vary according to the technical characteristics and/or the visual effects desired.

In the examples shown, the bars are formed by a succession of folds and counter folds of a leaf of rubber material, such that all the bars are in one piece.

Figure 2A:
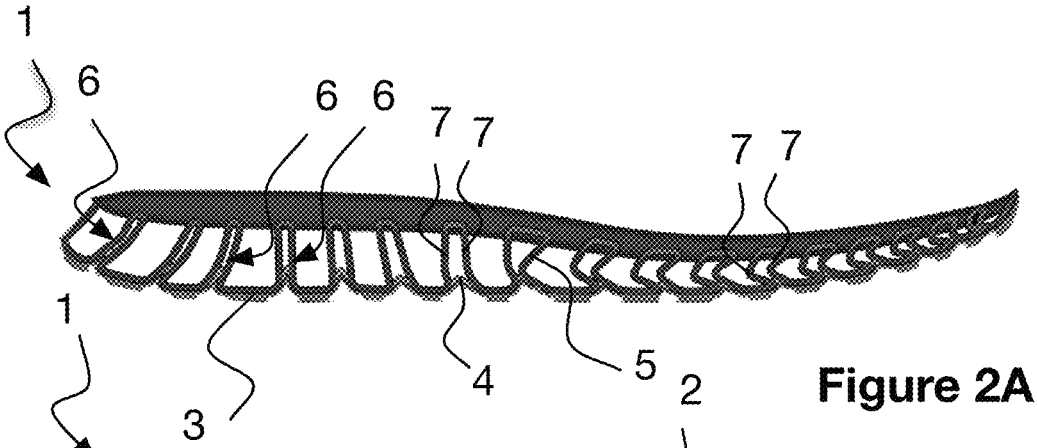
FIG. 2A is a front view of the sole in FIG. 1.
Figure 2B:
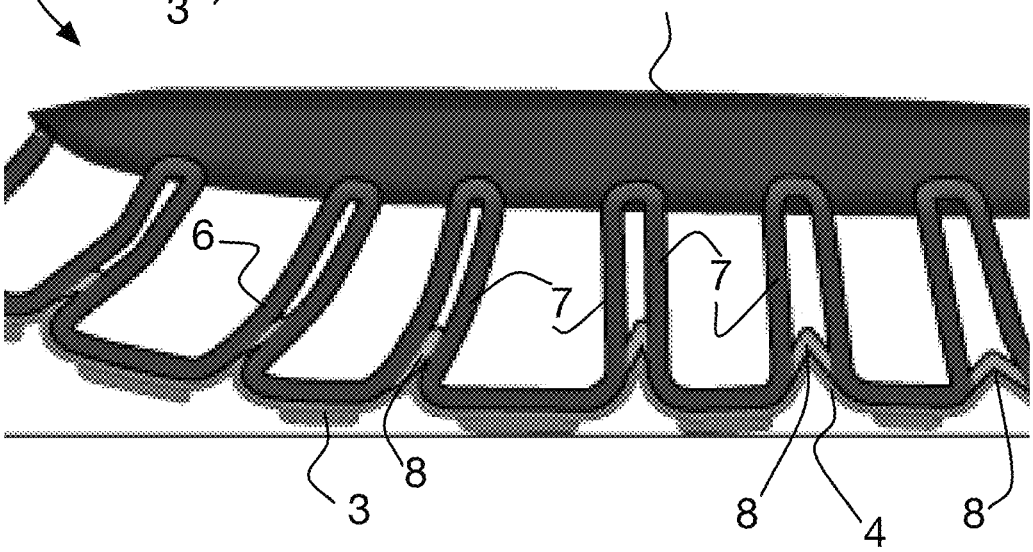
FIG. 2B is an enlarged view of a portion of the sole in FIG. 2A.

More particularly, as is easily visible in FIGS. 1, 2A and more particularly 2B, each bar is formed by the arrangement of two walls 7 which are arranged at close proximity to one another. Said arrangement allows a good level of rigidity to be obtained with walls that are relatively thin so as to allow a very light sole to be thus obtained.

To make up the sole, the bars are fixed on one side against the lower surface of the insole 2, and on the other side against the upper surface of the outsole 3.

Finally, the outsole 3 forms, between the bars, a plurality of elastic areas 4, at least some of which comprises a fold 8, forming a reserve of material. The elastic areas 4, and more particularly the folds 8 allow for two types of deformation of the outsole 3.

First of all, at the start of the mechanical load, the elastic areas are deformed plastically by unfolding the folds 8. Said first level allows for partial weakening of the bars.

Then, progressively, when the mechanical load continues and/or increases in intensity, the elastic areas are deformed elastically by stretching the elastomeric material. Said second level allows the weakening of the bars to be continued up to possibly reaching total collapse of some or all of the bars, according to the distribution of the force of the foot. In use, the two levels of weakening of the bars allow for progressive crushing of the sole, according to the intensity of the force exerted by the user. The two levels are advantageously controlled so as to obtain progressive deformation of the sole. The presence of a plurality of bars substantially close to one another allows the user to benefit from continuous support, without any fits and starts, for great comfort.

Figure 4:
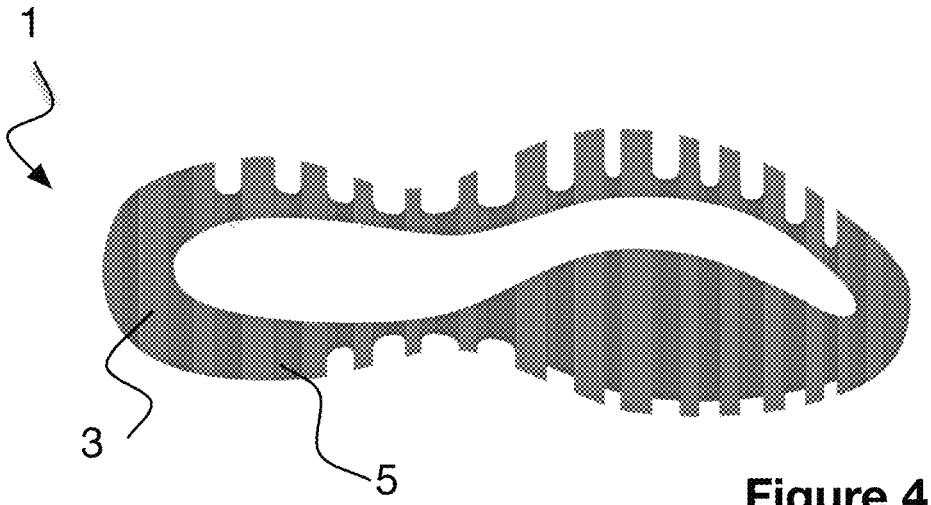
FIG. 4 is a view from below of an example of the sole without the insole.
Figure 5:
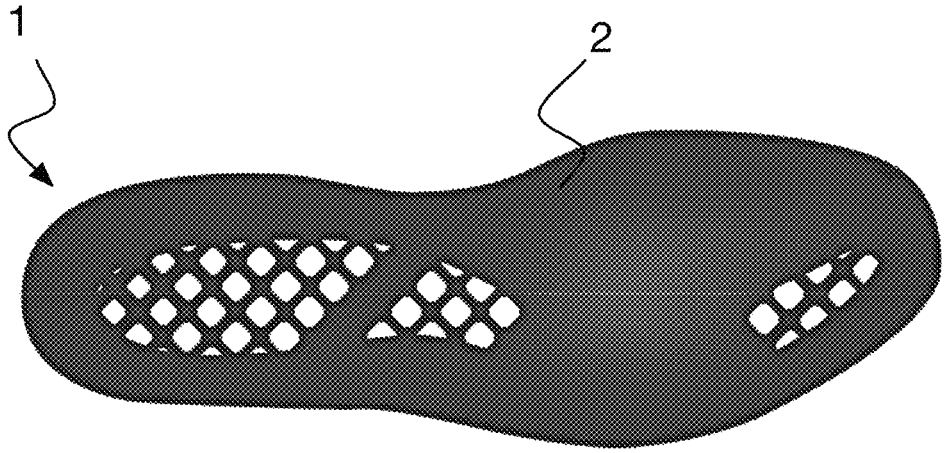
FIG. 5 is a view from below of just the insole.
Figure 6:
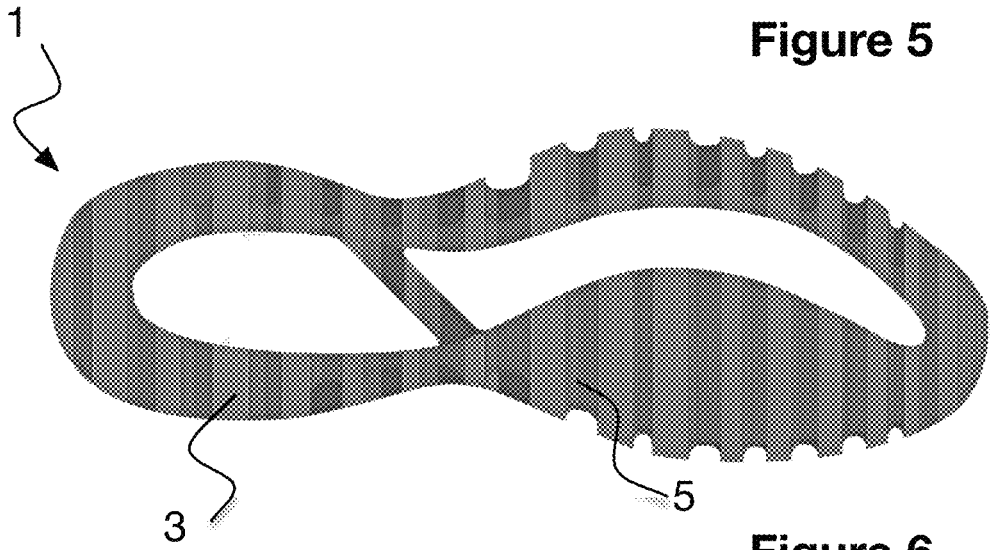
FIG. 6 is a view from below of another embodiment of the sole (without the insole).

FIGS. 4 and 6 are views from below of examples of soles, shown without the insole. FIG. 5 is a view from below of just the insole.

PRODUCTION

The insole 2, the bars 6 and the outsole 3 are obtained by injection, preferably using a single injectable material. A composition or an elastomeric mixture is used in an advantageous manner.

The elastic areas 4 are produced in one piece with the outsole 3 which is itself produced in one piece with the bars 6 of the midsole 5. All these elements are advantageously produced in one piece with the insole 2.

The sole is realized in an advantageous manner by means of injection. As a variant, the sole is realized in an advantageous manner by the addition of material (commonly referred to as "3D printing"). Said method of production allows very complicated designs to be realized, in one single step.

The two processes above allow the industrialization of soles to be automated, with considerable cost savings. Furthermore, the sole is realized in one single step, in contrast to classic soles which require several operations one after another and a large workforce. Thanks to these advantages, the soles can be produced close to the point of consumption. It is thus possible to speed up the stages of placing the products on the market significantly and to reduce transport costs as well as harmful emissions.

REFERENCE NUMBERS USED IN THE FIGURES

1 Sole
2 Insole
3 Outsole
4 Elastic areas
5 Midsole
6 Bars
7 Wall
8 Fold (or reserve of elastic material)
9 Area with substantially transversal bars
10 Area with bars at an angle with respect to the longitudinal axis L-L
11 Area with substantially longitudinal bars

The invention claimed is:

1. A shoe sole comprising an outsole, an insole, and a midsole which extends between the insole and the outsole, the midsole being composed of a plurality of bars which are arranged lengthwise of the sole, the insole, the bars and the outsole being composed of an elastomeric material, the bars being fixed on one side against a lower surface of the insole and on another side against an upper surface of the outsole, the outsole forming, between the bars, a plurality of elastic areas, at least part of which comprises a fold, wherein the bars are formed by a succession of folds and counter folds of a leaf of rubber material, such that all the bars are in one piece, wherein, in use, when a user applies a first level of mechanical load, the folds are unfolded, thereby causing a first level of deformation of the bars, and when the user applies a second level of mechanical load, greater than the first level of mechanical load, the elastic areas are deformed elastically by stretching the elastomeric material, thereby causing a second level of deformation of the bars, greater than the first level of deformation, and wherein the first and second levels of deformation of the bars allow a progressive crushing of the sole according to an intensity of force exerted by the user.

2. The shoe sole according to claim 1, wherein each bar is formed by an arrangement of two walls which are arranged in close proximity to one another.

3. The shoe sole according to claim 1, wherein the outsole is produced in one piece with the bars of the midsole.

4. The shoe sole according to claim 1, wherein the elastic areas are produced in one piece with the bars.

5. The shoe sole according to claim 1, wherein at least some of the bars are substantially transversal.

6. The shoe sole according to claim 1, wherein at least some of the bars are substantially longitudinal.

7. The shoe sole according to claim 1, wherein at least some of the bars are aligned at an angle which is included between 0° and 90° with respect to the longitudinal axis of the sole.

8. The shoe sole according to claim 1, wherein the sole comprises several sets of bars including a set of substantially transversal bars and a set of substantially longitudinal bars.

9. The shoe sole according to claim 1, wherein at least some of said bars are interrupted in the middle portion of the sole.

10. A shoe comprising a sole according to claim 1.

11. The shoe sole of claim 1, wherein the first and second levels of deformation, when exposed to the effects of a first level of mechanical load originating from the foot of the user, permit the folds of the outsole to be deployed, causing a first level of elongation, and, when exposed to the effects of a second level of mechanical load originating from the foot, greater than the first level of mechanical load, allow the material of the elastic areas to be deformed by stretching, causing a second level of elongation of the outsole, greater than the first level of elongation.

12. The shoe sole of claim 11, wherein the two levels of elongation allow for progressive crushing of the sole, according to the intensity of the mechanical load exerted by a user.

13. The shoe sole of claim 1, wherein the second level of deformation of the bars corresponds to a total collapse of at least some of the bars.

* * * * *